US007406908B1

(12) United States Patent
Goon et al.

(10) Patent No.: US 7,406,908 B1
(45) Date of Patent: Aug. 5, 2008

(54) METHOD OF MAKING A ONE-PIECE LOOP FOR AMMUNITION CARTRIDGE

(75) Inventors: Eric Goon, Mountain Lakes, NJ (US); Stojan Kotefski, Bloomingdale, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/163,037

(22) Filed: Oct. 3, 2005

Related U.S. Application Data

(60) Provisional application No. 60/522,468, filed on Oct. 4, 2004.

(51) Int. Cl.
*F42B 39/08* (2006.01)

(52) U.S. Cl. ..... 89/35.01; 89/34

(58) Field of Classification Search ..... 89/34, 89/35.01
See application file for complete search history.

(56) References Cited

U.S. PATENT DOCUMENTS

| | | | | | |
|---|---|---|---|---|---|
| 1,150,435 | A | * | 8/1915 | Laird et al. | 89/35.01 |
| 2,366,887 | A | * | 1/1945 | Warren | 89/35.01 |
| 2,379,510 | A | * | 7/1945 | Ewart | 89/35.02 |
| 2,397,944 | A | * | 4/1946 | Bureau | 86/48 |
| 2,423,346 | A | * | 7/1947 | Ryan | 89/35.02 |
| 2,453,540 | A | * | 11/1948 | Reid | 89/35.02 |
| 2,562,709 | A | * | 7/1951 | French et al. | 89/35.02 |
| 2,809,563 | A | * | 10/1957 | Hammer | 89/35.02 |
| 4,724,739 | A | * | 2/1988 | Heberlein | 89/33.2 |
| 5,398,590 | A | * | 3/1995 | Snyder, Sr. | 89/33.16 |
| 5,546,845 | A | * | 8/1996 | Wossner et al. | 89/35.01 |

* cited by examiner

*Primary Examiner*—Bret Hayes
(74) *Attorney, Agent, or Firm*—John F. Moran

(57) ABSTRACT

A one-piece metal cartridge loop has no welds and no overlapping parts. The cartridge loop includes a plurality of locking tabs for positioning a cartridge therein. One end of the cartridge loop includes a coupling interface and another end of the cartridge loop includes a coupling support. A method of making the non-welded cartridge loop is disclosed.

7 Claims, 4 Drawing Sheets

METHOD OF MAKING A ONE-PIECE LOOP FOR AMMUNITION CARTRIDGE

CROSS-REFERENCE TO RELATED APPLICATIONS

This application claims the benefit under 35 USC 119(e) of U.S. provisional patent application 60/522,468 filed on Oct. 4, 2004, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to apparatus for transporting ammunition cartridges through a gun firing system and, in particular, to a transport apparatus that uses loops and couplings.

To convey ammunition cartridges, for example, 40 mm cartridges, through a weapon, a transport means is necessary to position and guide the cartridges through the gun firing system. The transport means may include couplings and loops. The cartridges are positioned in the loops and the couplings link the loops together. FIG. 1 shows cartridges 10 disposed in loops 12 that are connected by a coupling 14. FIG. 2 shows two loops 12 without the cartridges 10. The couplings and loops are physically shocked, pulled and distorted throughout the firing cycle and, therefore, require a certain strength to function properly.

FIG. 3 is a perspective view of a known loop 50 prior to assembly. Loop 50 comprises two parts 52 and 54. Part 52 includes a coupling interface 56 and side members 62. Part 54 includes a coupling support 58 and side members 60. FIG. 4 is a perspective view of the known loop 50 after assembly. In the known loop 50, the two parts 52, 54 are overlapped and then joined by welding. The side members 62 overlap the side members 60 and are projection welded in place, as at 64. There are also projection welds 64 on the opposite side members, although they are not visible in FIG. 4.

The weld joints 64 are one source of operational and production problems. During surface preparation, the assembled part 50 is bathed in cleansers, such as acid. The acid seeps between the overlapped side members 60, 62 and cannot be fully rinsed away. During long-term storage, the acid etches away at members 60, 62 and projection welds 64 and may ultimately cause failure of the loop 50.

The weld joints 64 are also prone to failure because of variables in the projection welding process, such as amperage, projection weld contact variations and surface preparation variation. The welded loops 50 must be surface finished, i.e., phosphated after welding. The weld joint 64 is difficult to phosphate. The strength of the weld 64 varies from vendor to vendor and set-up to set-up. Long-term storage of the welded loops 50 is affected by the lack of consistent coating at the weld joint 64, allowing rust to develop and degrade the weld strength. Manufacturers continually increase the price for the loops 50 because of welding and finishing difficulties.

SUMMARY OF THE INVENTION

It is an object of the invention to provide a cartridge loop that is one-piece.

Another object of the invention is to provide a cartridge loop that has no welds.

A further object of the invention is to provide a cartridge loop with no overlapping pieces.

Yet another object of the invention is to provide a cartridge loop that is lighter in weight than the known loop.

Still another object of the invention is to provide a method of making a one-piece cartridge loop that has no welds.

One aspect of the invention is an apparatus comprising a one-piece metal cartridge loop having no welds and no overlapping parts. The cartridge loop may include a plurality of locking tabs for positioning a cartridge therein. One end of the cartridge loop may include a coupling interface and another end of the cartridge loop may include a coupling support. Preferably, the locking tabs are operable to position a 40 mm cartridge.

Another aspect of the invention is a method of making a one-piece cartridge loop having no welds comprising providing generally tubular raw material; forming the external profile of the loop from the tubular raw material; and forming mechanical details of the loop. The mechanical details may include a plurality of locking tabs, a coupling support and a coupling interface. The step of forming mechanical details may include notching, machining and/or kinking.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The present invention is a one-piece cartridge loop that eliminates the known overlapping weld joint. The elimination of the overlapping weld joint provides a stronger cartridge loop by replacing the projection weld joint with solid steel. The finishing process is easier because there is no longer an overlapping weld joint to clean and finish. Because the finishing process is more uniform and consistent, the loops have a longer shelf life. Eliminating the weld joint reduces the fabrication costs because less raw material is used and no weld testing is required. A weight reduction of about 15% is realized by omitting the overlapping weld joint.

Figure 1:
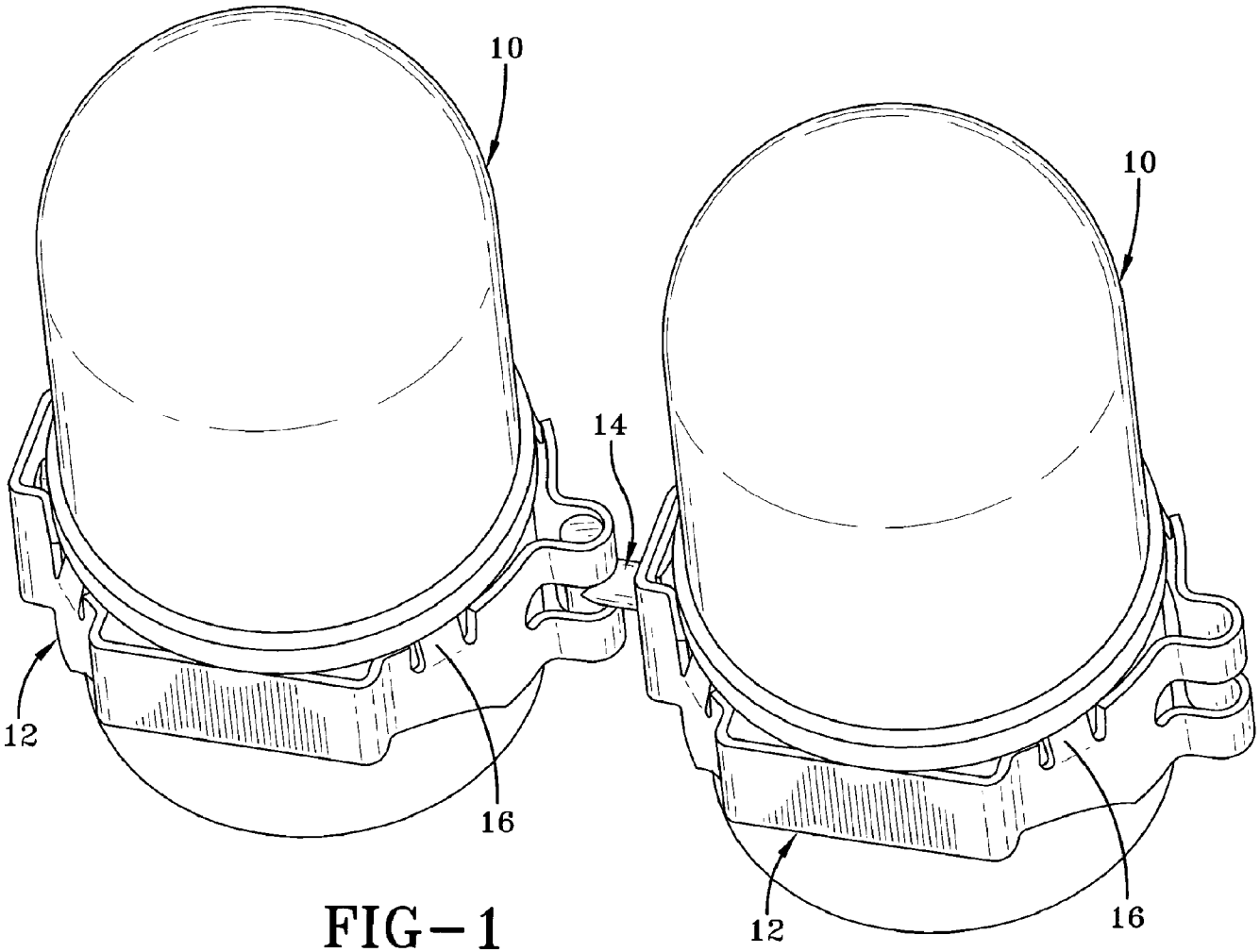
FIG. 1 is a perspective view of cartridges disposed in loops according to the invention.
Figure 2:
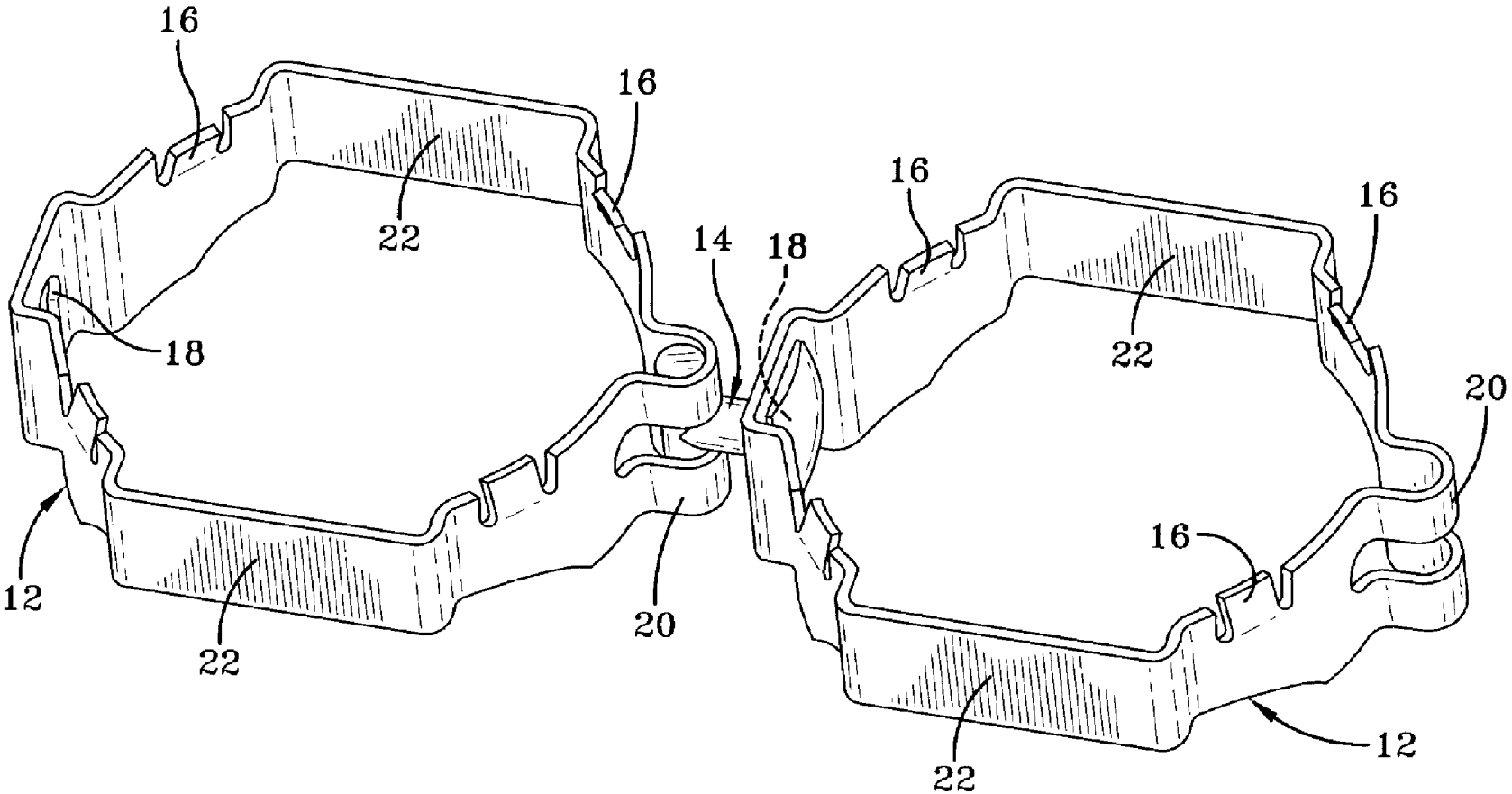
FIG. 2 shows the loops of FIG. 1 without the cartridges.

FIG. 1 shows cartridges 10 (such as 40 mm cartridges) disposed in loops 12 that are connected by a coupling 14. FIG. 2 shows two loops 12 without the cartridges 10. Loops 12 are one-piece metal cartridge loops that have no welds and no overlapping parts, particularly in the side members 22 (FIG. 2). Cartridge loop 12 includes a plurality of locking tabs 16 for positioning a cartridge 10 therein. One end of the cartridge loop 12 includes a generally keyhole shaped coupling interface 18 and the other end of the loop 12 includes a coupling support 20. Coupling 14 engages the coupling interface 18 and coupling support 20 to connect adjacent loops 12. A particular advantage of the inventive loops 12 is their interchangeability with the known loops 50.

Figure 3:
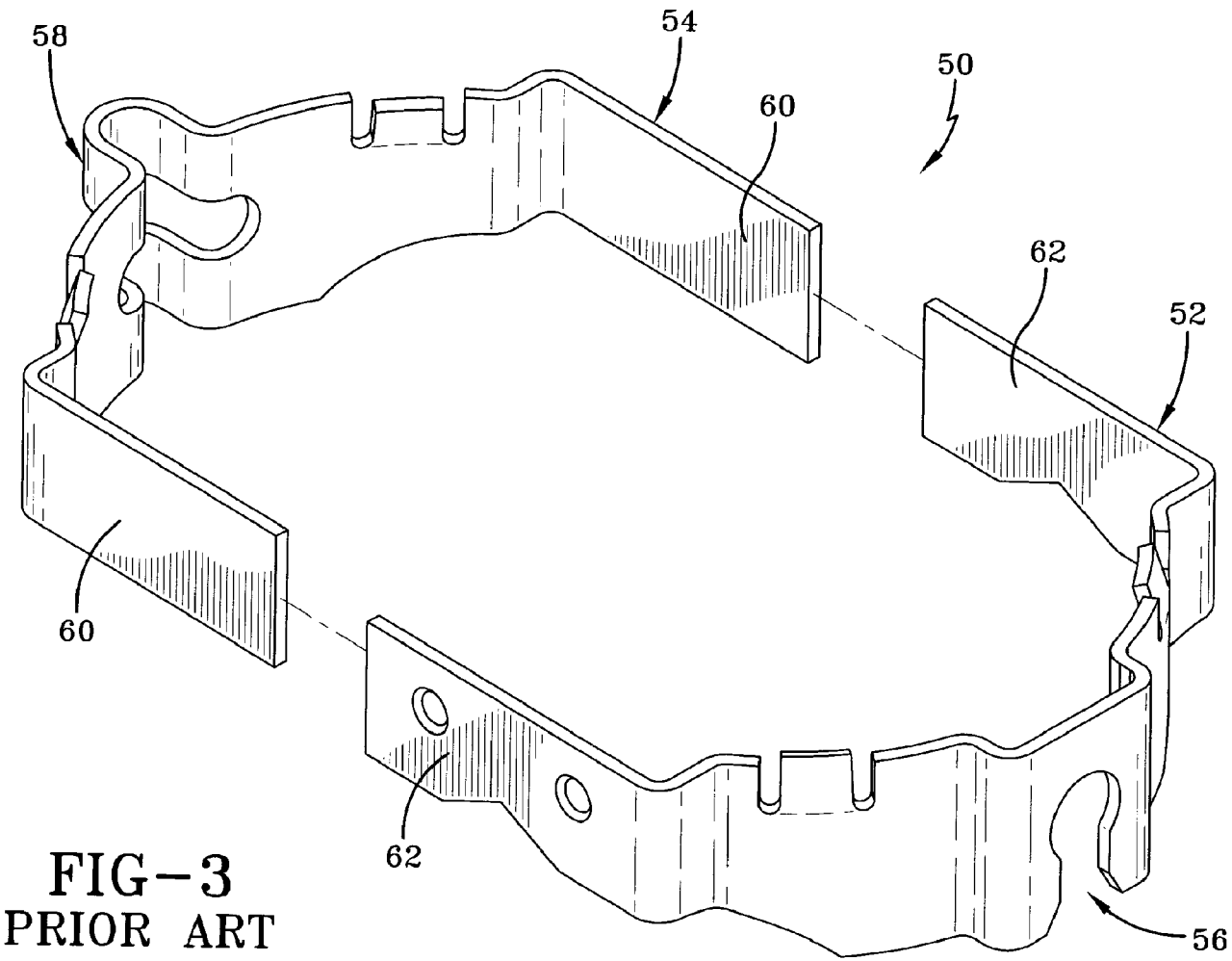
FIG-3 PRIOR ART
FIG. 3 is a perspective view of a known loop prior to assembly.
Figure 4:
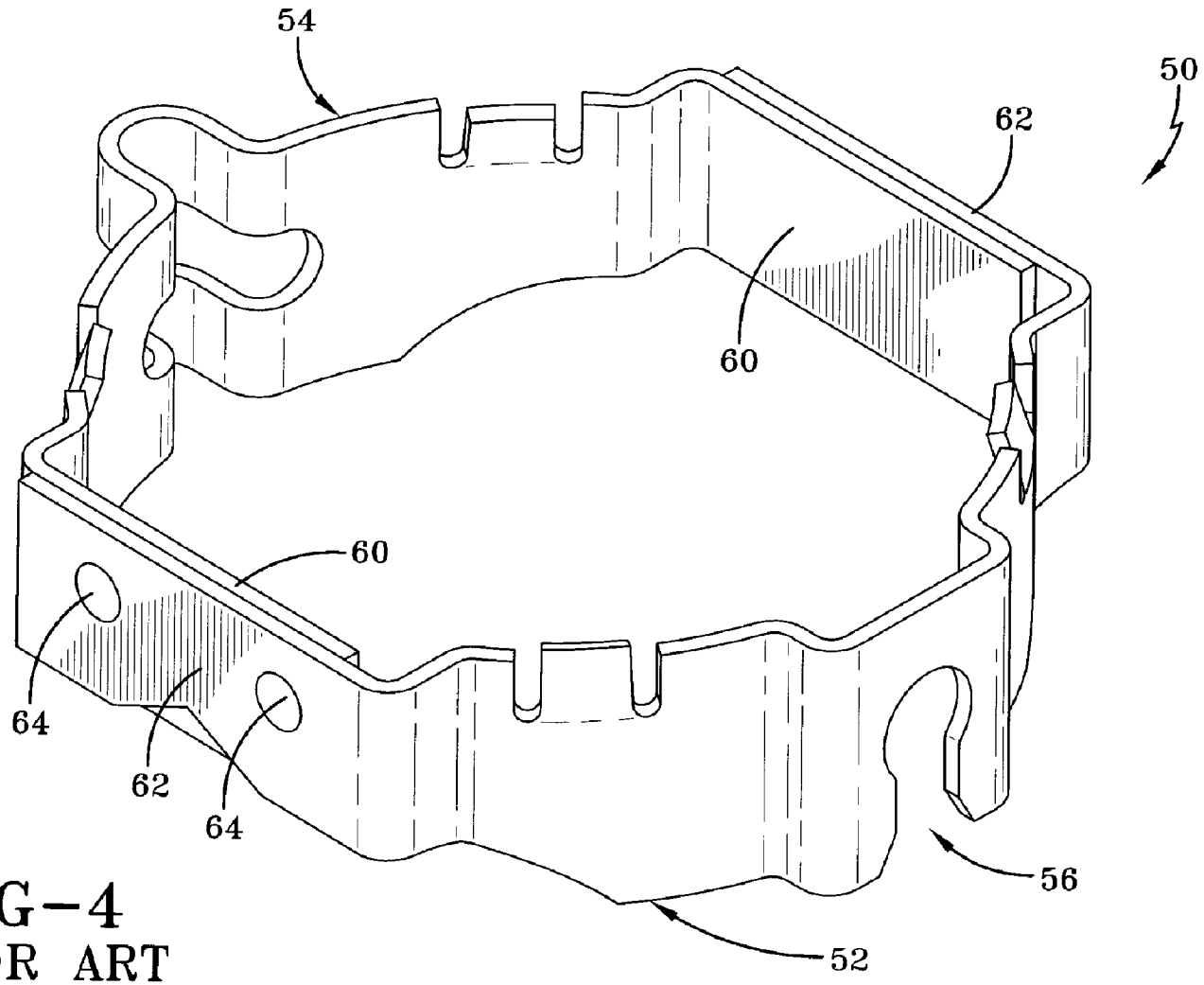
FIG-4 PRIOR ART
FIG. 4 is a perspective view of a known loop after assembly.

A method for making the known loops 50 shown in FIGS. 3 and 4 begins by stamping flat sheet stock. The flat, stamped portions are notched, pierced and formed. The portions are bent to form the two parts 52, 54 shown in FIG. 3. The ends of the side members 60, 62 are located and fixed and then projection welded. A series of cleaning and surface preparation operations follows. The projection welds 64 are tested. The result is the loop 50 with its double thick, overlapped joint that is welded together.

In accordance with the invention, a method of making a one-piece cartridge loop 12 includes providing generally tubular raw material made of, for example, steel. The tubular raw material may be formed by, for example, extrusion. The external profile of the loop 12 is formed from the tubular raw material. The mechanical details of the loop are formed by, for example, notching, kinking and/or machining. The mechanical details include the coupling interface 18, the coupling support 20 and the locking tabs 16. Preferably, all the locking tabs 16 are formed simultaneously. Simultaneous formation of the locking tabs 16 on a single loop 12 minimizes variations in the locking tabs, such as may occur in the prior method wherein the locking tabs are formed on the separate pieces 52, 54. Notably, no welding is used to form the side members 22. The loop 12 undergoes conventional surface preparation and finishing processes.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A method of making a one-piece cartridge loop having no welds and no overlapping parts, comprising:

providing generally tubular raw material;

forming an external profile of the loop from the tubular raw material; and forming mechanical details of the loop.

2. The method of claim 1 wherein the step of forming mechanical details includes notching.

3. The method of claim 1 wherein the step of forming mechanical details includes machining.

4. The method of claim 1 wherein the step of forming mechanical details includes forming a plurality of locking tabs.

5. The method of claim 4 wherein the plurality of locking tabs are formed by kinking.

6. The method of claim 1 wherein the step of forming mechanical details includes forming a coupling support on one end of the loop and a coupling interface on another end of the loop.

7. The method of claim 1 further comprising forming the generally tubular raw material by extrusion.

* * * * *